US006103188A

United States Patent [19]

Guixá Arderiu et al.

[11] Patent Number: 6,103,188

[45] Date of Patent: Aug. 15, 2000

[54] HIGH-CONDUCTIVITY COPPER MICROALLOYS OBTAINED BY CONVENTIONAL CONTINUOUS OR SEMI-CONTINUOUS CASTING

[75] Inventors: José Oriol Guixá Arderiu, Barcelona; Miquel Garcia Zamora, Moia; Ferran Espiell Alvarez, Barcelona; Miquel `Angel Fernandez Lopez, Barcelona; Araceli Esparducer Broco, Barcelona; Mercè Segarra Rubik, Barcelona; Josep Mª Chimenos Ribera, Barcelona, all of Spain

[73] Assignee: La Farga Lacambra, S.A., Les Masies De Voltrega, Spain

[21] Appl. No.: 09/262,709

[22] Filed: Mar. 4, 1999

[30] Foreign Application Priority Data

Mar. 5, 1998 [ES] Spain ..... 9800468
Feb. 8, 1999 [ES] Spain ..... 9900256

[51] Int. Cl.[7] ..... C22C 9/02; C22C 9/04; C22C 9/06; C22C 9/08

[52] U.S. Cl. ..... 420/473; 420/470; 420/473; 420/474; 420/475; 420/476; 420/477; 420/479; 420/481; 420/485; 420/487; 420/491; 420/496; 420/498; 420/499

[58] Field of Search ..... 420/469, 470, 420/473, 474, 475, 476, 477, 479, 481, 485, 487, 491, 496, 498, 499

[56] References Cited

U.S. PATENT DOCUMENTS 2,942,158 6/1960 Hassler et al. ..... 420/469
4,676,827 6/1987 Hosoda et al. ..... 752/65
4,717,436 1/1988 Hosoda et al. ..... 148/432
4,792,369 12/1988 Ogata et al. ..... 148/404
5,077,005 12/1991 Kato ..... 420/369
5,118,470 6/1992 Tanigawa et al. ..... 420/469

*Primary Examiner*—Daniel J. Jenkins
*Assistant Examiner*—Nicole Coy
*Attorney, Agent, or Firm*—Darby & Darby

[57] ABSTRACT

We provide a new copper microalloy with high-conductivity, excellent heat resistance and high strain strength, which can be obtained by conventional continuous or semi-continuous casting, which essentially consists of at least one element selected from the following list:

| | |
|---|---|
| 5–800 | mg/Kg Pb (lead) |
| 10–100 | mg/Kg Sb (antimony) |
| 5–1000 | mg/Kg Ag (silver) |
| 5–700 | mg/Kg Sn (tin) |
| 1–25 | mg/Kg Cd (cadmium) |
| 1–30 | mg/Kg Bi (bismuth) |
| 20–500 | mg/Kg Zn (zinc) |
| 10–400 | mg/Kg Fe (iron) |
| 15–500 | mg/Kg Ni (nickel) |
| 1–15 | mg/Kg S (sulfur) |

in all cases, with 20–500 mg/Kg O (oxygen). The alloy is suitable for all the applications that require an electrical conductivity similar to that of pure copper, but with a better heat resistance, better mechanical properties and lower standard deviation values in strain strength. Specifically, it can be used for electric wires with high mechanical requirements and/or high annealing temperatures, for high-risk applications and for electrical wires and components in the electronic and micro-electronic industry.

8 Claims, 3 Drawing Sheets

HIGH-CONDUCTIVITY COPPER MICROALLOYS OBTAINED BY CONVENTIONAL CONTINUOUS OR SEMI-CONTINUOUS CASTING

FIELD OF THE INVENTION

The present invention relates to high-conductivity multi-compound copper microalloy with a high recrystallization temperature and high strain strength that might be obtained by conventional continuous or semi-continuous casting, suitable for electric wires with high mechanical requirements and/or high annealing temperatures, for high-risk applications and for electrical wires and components in the electronic and micro-electronic industry.

BACKGROUND OF THE INVENTION

The basis of the strategy currently used to design multiple electric circuit devices is the use of a rigid metallic base with a high electric conductivity (generally made with copper or copper alloys). Until now, the need for a rigid metal base with a high temperature of elimination of the stress generated by cold deformation, thus maintaining its mechanical properties when heated by the current passing through, has forced the use of alloys with conductivities lower than that of high purity copper (normally between 35 and 70% IACS for strain strengths between 700 and 500 MPa, whereas high purity electrolytical copper generally presents strain strengths of 380 MPa and conductivities of 101% IACS).

The electric conductivity of commonly used alloys inevitably decreases as a high strain strength is needed.

The alloys that constitute the metal base are selected from a compositional series of binary and ternary alloys with an electric conductivity that decreases as their mechanical properties improve. For example, a copper/iron alloy often used for these functions presents an electric conductivity of 60% IACS and a strain strength of 550 MPa.

OBJECT OF THE INVENTION

The purpose of the present invention is to provide a copper microalloy with electrical conductivity values as close as possible to those obtained for copper with five nines purity (from here on, 5N copper) but with improved heat resistance and strain strength. The method used to produce this alloy can be conventional continuous or semi-continuous casting.

SUMMARY OF THE INVENTION

Large series of experiments with different microalloying elements added to the copper microalloy gave these unexpected results:

(a) Some metallic elements of the Periodic Table, Pb, Ag, Sn, Bi, Cd, Zn, Fe, Ni, one intermetallic, Sb, and one non-metallic, S, are suitable to be microalloyed with copper. Small amounts of these elements added to copper significantly increased the strain strength after 80% of cold-working. They also increased the temperature at which the strain strength started decreasing after of 80% cold-working (softening temperature), without seriously damaging on the electric conductivity.

(b) A non-metallic element, oxygen, is a desirable microalloying element because of its influence on the strain strength, but its influence on the softening temperature is not simple. This element is always present when the copper microalloy is obtained by conventional continuous or semi-continuous casting. The decreasing effect of oxygen on the softening temperature is highest at concentrations between 170 and 210 mg/Kg; this effect is lower at higher and lower oxygen concentrations.

(c) The copper microalloy obtained by adding a small amount of one metallic, intermetallic or non-metallic elements, Pb, Ni, Fe, Zn, Cd, Bi, Ag, Sn, Sb and/or S, and oxygen in a final concentration between 70 to 110 ppm presented a softening temperature 12K higher than when oxygen concentration was between 110 and 180 ppm. The softening temperature for the same microalloy but with an oxygen concentration between 180 and 300 ppm was 8K higher than that obtained for a microalloy with between 110 and 180 ppm of oxygen. This unexpected result allowed us to control the softening temperature by controlling the amount of oxygen in the alloy.

DETAILED DESCRIPTION

The alloying elements Pb, Sn, Sb, Ni, Cd, Bi, Fe, Zn and Ag form a solid solution with copper. The presence of these elements at a concentration equal to or higher than certain ones resulted in higher strain strength values than those obtained for (5N) copper.

Oxygen also increases the strain strength of the copper alloy, because of the higher energy of the crystal net obtained.

Besides, the alloying elements Pb, Sn, Sb, Ni, Cd, Bi, Fe, Zn and Ag, which form a solid solution with copper, also increased the softening temperature of the copper alloy, as the mechanical properties of copper remained constant or increased at higher temperatures than in (5N) Cu. This resulted in a higher heat resistance. For this property, the presence of oxygen was not so desirable, as it decreased the softening temperature of the alloy, however, its effect on this property was not very important.

The presence of these elements at lower concentration than that described here had a low or negligible effect on heat resistance, strain strength and electric conductivity of the alloy.

At higher concentrations, these elements improved heat resistance and strain strength of the microalloy, but electric conductivity was much lower and the absence of precipitates of the microalloying elements was not ensured.

Therefore, the ranges of concentrations for the elements, Pb, Sn, Zn, Ag, Ni, Fe and Sb at which the desired effects were present are, by weight: 5–800 ppm Pb, 5–700 ppm Sn, 20–500 ppm Zn, 1–25 ppm Cd, 1–25 ppm Bi, 5–1000 ppm Ag, 15–500 ppm Ni, 10–400 ppm Fe, 10–100 ppm Sb and 1–15 ppm S, with an oxygen concentration between 20 and 500 ppm. In all cases, the total sum of all the amounts of microalloying elements, excluding oxygen and silver, was equal to or lower than 1000 weight ppm.

Figure 3:
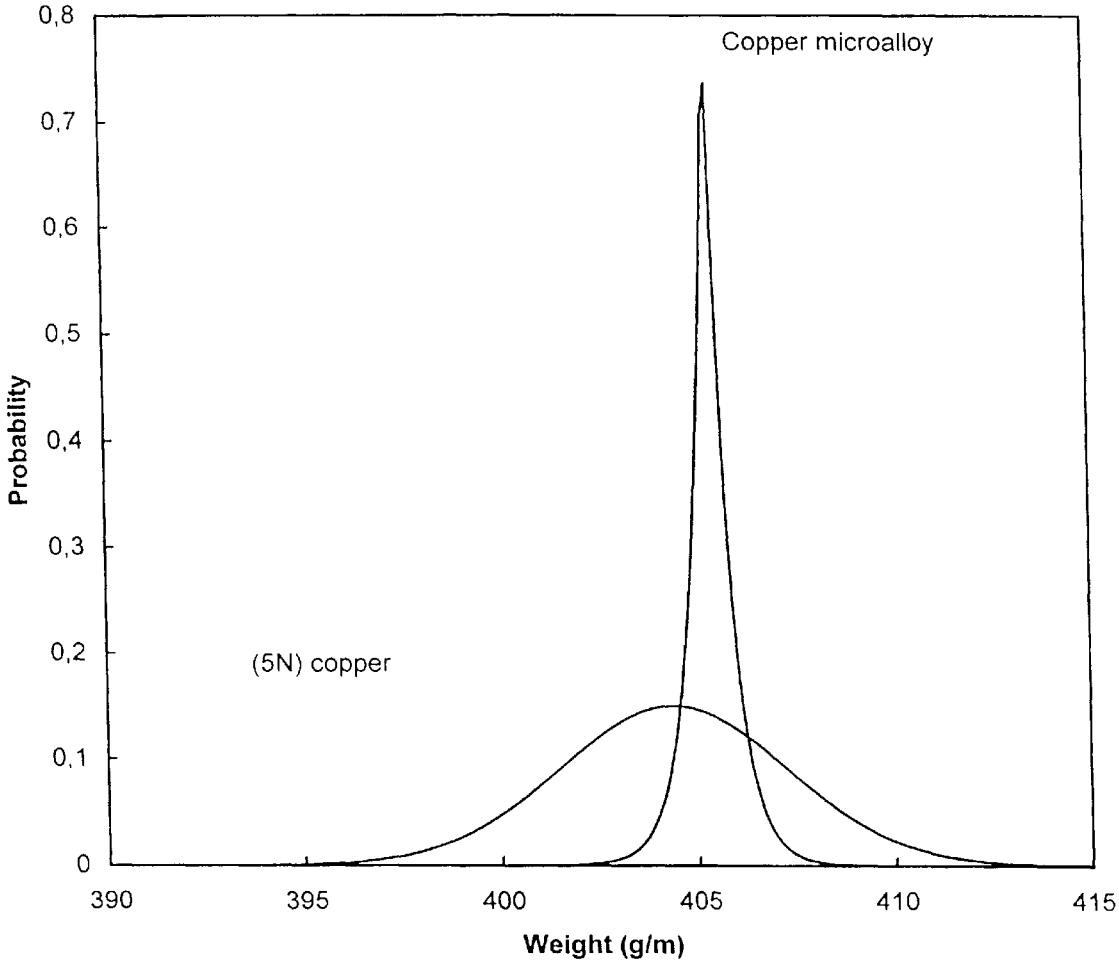
FIG. 3 compares the statistical distribution of weight for 1 m of bunched wire of 50 $mm^2$-dia. between (5N) copper and for a large amount of samples of the described microalloy.

Oxygen presented an effect on the heat resistance of the microalloy which was different than that of the other microalloying elements. The presence of some tens of weight ppm of oxygen decreased the heat resistance of the microalloy. The softening temperature remained constant at oxygen concentrations between 70 and 110 weight ppm. An oxygen concentration of 110 to 180 ppm in the copper alloy resulted in the lowest softening temperature for each copper microalloy composition. Oxygen amounts between 180 and 300 ppm for each microalloy composition increased the softening temperature, although this was constant in all the range of concentrations. These oxygen intervals can be obtained by conventional continuous or semi-continuous casting. These results allowed control of the mechanical-thermal properties of the cooper alloy with the oxygen composition. Besides, the determination of the weight of 1 m of bunched wire of 50 $mm^2$-dia. for a large number of those microalloys revealed that the deviation from the mean calculated value was much lower than that (5N) copper, FIG. 3. It also reveals that the mean weight value for those microalloys was closer to the maximum theoretical weight for the same bunched wire than the weight value obtained for (5N) copper. This important result can be explained by the improved dimensional control observed in those microalloys. When the microalloyed copper is being cold-worked, it is more difficult to propagate a defect than when (5N) copper is used, because the dimensional deviation of the microalloy is lower than that of (SN) copper. Therefore, there is a lower amount of breakages during the performance of the different products obtained after hot-working or cold-working. This is especially important in applications such as electric wire with high mechanical requirements; these wires need an improved dimensional control in order to guarantee strain strength values while altering electric conductivity as little as possible.

Other interesting advantages of the described copper alloy are the following:

1) The exposed microalloying elements are commonly found in copper scrap, but often in higher concentrations than required. An optimised fire-refining method of copper scrap might be used to produce these alloys, which would then be adjusted for each microalloying element. 2) Due to the low concentration of the different microalloying elements, no precipitates or inclusions are observed. The control of the amount of oxygen present in the alloy makes the alloy free of voids.

3) Despite the influence of oxygen concentration on the softening temperature, the benefit of the other alloying elements on the desired properties and of the oxygen on the strain strength, together with the production of the alloy by conventional continuous or semi-continuous casting, make this alloy very profitable from the economical point of view.

4) Present-day copper-wire-technologies allow the fabrication of wires with that alloy without damaging the final quality of the product.

EXAMPLES

Some microalloy compositions were obtained by fire-refining copper scrap and continuous casting. The final product was an 8 mm diameter rod for each of the microalloys described in Table 1. Then, each rod was cold-worked in order to obtain 1,8 mm diameter wire. After annealing samples of each composition at different temperatures, the softening temperature was determined for each microalloy as the temperature at which elongation to rupture was higher than 10%. Electric conductivities were also measured for the 1,8 mm-dia. wire. Table 1 also shows the softening temperature and the electric conductivity for each microalloy composition.

In order to determine the effect of each microalloying element on the mechanical properties of the microalloy, different samples of microalloy 11 wire were annealed at different temperatures and tensile tested. The results are shown in Table 2.

TABLE 2

| Temperature (° C.) | 200 | 225 | 250 | 300 | 350 | 400 |
|---|---|---|---|---|---|---|
| Percentage of reduction | 7 | 20 | 30 | 40 | 45 | 46 |

This alloy gave a strain strength of 532 MPa after being cold-worked, a strain strength of 551 MPa after cold-rolling the cold-worked wire and an electric conductivity of 99,8% I.A.C.S. as a wire.

The reduction of the strain strength after 100 hours at 200° C. was 20%.

Figure 1:
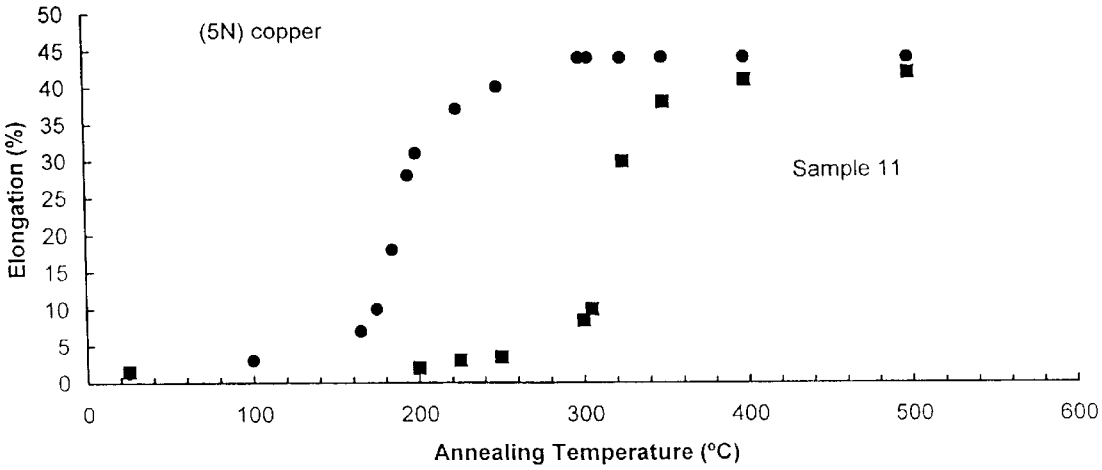
FIG. 1 shows elongation and annealing temperature after 2 hours of heat treatment for the alloy composition described in EXAMPLES as sample 11.
Figure 2:
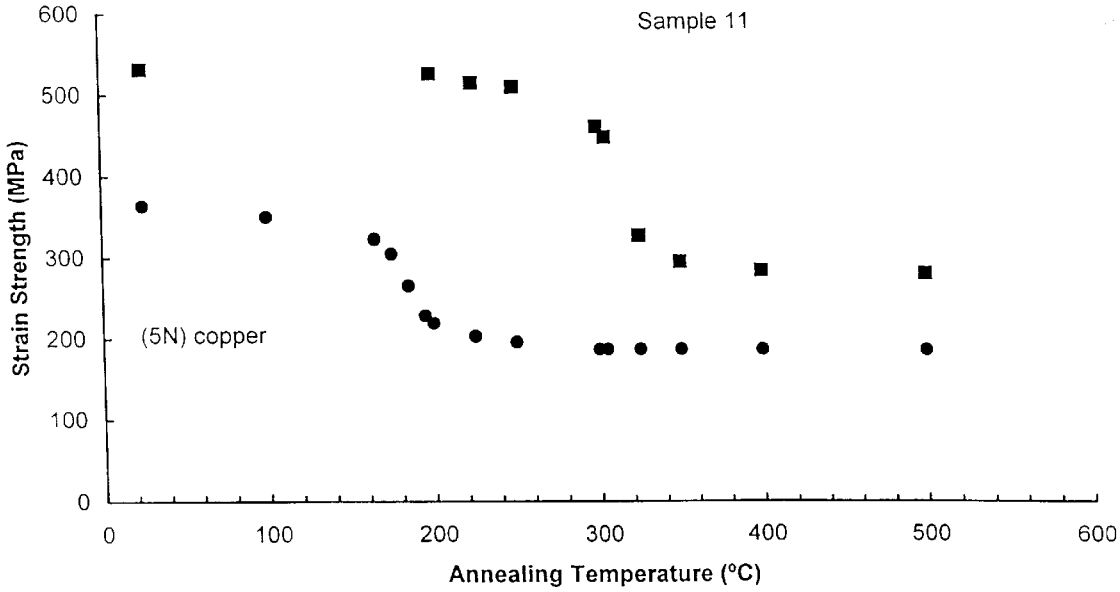
FIG. 2 shows the strain strength and annealing temperature after 2 hours of heat treatment for the alloy composition described in EXAMPLES as sample 11.

FIG. 1 shows the variation of the elongation and the annealing temperature after exposing 80% cold-worked wire of microalloy 11 and (SN) copper to different temperatures for 2 hours. FIG. 2 shows the variation of the strain strength for the same samples after exposure to different temperatures for 2 hours. These figures indicate that microalloys of this kind have a set of properties that make them highly desirable, and which have not been reported previously.

TABLE 1

Microalloy composition, softening temperature and electric conductivity

| ample | Cu + Ag (%) | Pb (ppm) | Sn (ppm) | Ni (ppm) | Ag (ppm) | Sb (ppm) | Fe (ppm) | Cd (ppm) | Bl (ppm) | Zn (ppm) | S (ppm) | Oxygen (ppm) | Soft-ening temper-ature (° C.) | Con-duct-ivity (% IACS) | Strain Strength (MPa) |
|---|---|---|---|---|---|---|---|---|---|---|---|---|---|---|---|
| 1 | 99.93 | 501 | 17 | 46 | 12 | 15 | 62 | 0.3 | 0.9 | 33 | 12 | 177 | 195 | 100.9 | 405 |
| 2 | 99.95 | 375 | 21 | 30 | 10 | <0.7 | 9 | 0.2 | 1.4 | 26 | 12 | 204 | 201 | 100.2 | 400 |
| 3 | 99.95 | 52 | 265 | 132 | 29 | 12 | <0.7 | 5.1 | 0.8 | 8 | 8 | 141 | 206 | 100.0 | 406 |
| 4 | 99.96 | 141 | 71 | 78 | 58 | 12 | 23 | 0.3 | 2.0 | 28 | 6 | 138 | 225 | 100.9 | 405 |
| 5 | 99.92 | 395 | 99 | 103 | 92 | 23 | 16 | 3.5 | 2.2 | 118 | 3 | 182 | 230 | 100.6 | 444 |
| 6 | 99.92 | 365 | 158 | 134 | 142 | 22 | 18 | 3.3 | 1.8 | 96 | 7 | 174 | 238 | 100.4 | 465 |
| 7 | 99.93 | 389 | 97 | 91 | 95 | 12 | 19 | 2.1 | 2.7 | 39 | 6 | 245 | 242 | 100.8 | 445 |
| 8 | 99.92 | 428 | 79 | 145 | 115 | 21 | 24 | 4.7 | 1.3 | 95 | 4 | 286 | 270 | 99.8 | 432 |
| 9 | 99.93 | 482 | 75 | 80 | 75 | 12 | 10 | 3.0 | 2.3 | 56 | 9 | 332 | 290 | 100.3 | 428 |

TABLE 1-continued

Microalloy composition, softening temperature and electric conductivity

| ample | Cu + Ag (%) | Pb (ppm) | Sn (ppm) | Ni (ppm) | Ag (ppm) | Sb (ppm) | Fe (ppm) | Cd (ppm) | Bl (ppm) | Zn (ppm) | S (ppm) | Oxygen (ppm) | Soft-ening temper-ature (° C.) | Con-duct-ivity (% IACS) | Strain Strength (MPa) |
|---|---|---|---|---|---|---|---|---|---|---|---|---|---|---|---|
| 10 | 99.94 | 46 | 275 | 192 | 42 | 11 | 37 | 2.0 | 1.9 | 21 | 13 | 95 | 305 | 100.0 | 449 |
| 11 | 99.94 | 364 | 67 | 52 | 468 | 67 | 26 | 3.4 | 1.8 | 48 | 5 | 170 | 305 | 99.8 | 532 |
| 12 | 99.91 | 101 | 589 | 107 | 49 | 16 | 19 | 1.2 | 2.3 | 27 | 9 | 182 | 355 | 100.1 | 510 |

ADVANTAGES OF THE INVENTION

The present invention provides a copper alloy with excellent conductivity, higher strain strength values, lower standard deviations in strain strength, and higher softening temperature than (5N) copper or the alloys commonly used in electricity/electronics. This alloy can be obtained by conventional continuous or semi-continuous casting.

What is claimed is:

1. A high-conductivity copper alloy, consisting essentially of (4N) Cu and at least one element selected from the group consisting of:

5–800 mg/Kg lead,

10–100 mg/Kg antimony,

5–1000 mg/Kg silver,

5–700 mg/Kg tin,

20–500 mg/Kg zinc,

1–25 mg/Kg cadmium,

1–30 mg/Kg bismuth,

10–400 mg/Kg iron,

1–15 mg/Kg sulfur, and

15–500 mg/Kg nickel, in which oxygen must be present at a concentration of between 20 and 500 mg/Kg.

2. A wire made of the copper alloy described in claim 1.

3. A high mechanical requirements electric rod or wire with high electrical conductivity (at least 99% IACS) made of the copper alloy described in claim 1.

4. A high mechanical requirements electric wire or rod with low standard deviations in strain strength and/or deformation to rupture, made of the copper alloy according to claim 1.

5. A magnet wire formed from copper alloy according to claim 1.

6. A lead wire for an electronic component formed from copper alloy described in claim 1.

7. A lead member for tape automated bonding made of the copper alloy described in claim 1.

8. A member for a printed circuit board, made of the copper alloy described in claim 1.

* * * * *